US005971297A

United States Patent [19]

Sesser

[11] Patent Number: 5,971,297

[45] Date of Patent: Oct. 26, 1999

[54] SPRINKLER WITH NOZZLE VENTURI

[75] Inventor: George Sesser, Walla Walla, Wash.

[73] Assignee: Nelson Irrigation Corporation, Walla Walla, Wash.

[21] Appl. No.: 09/000,617

[22] Filed: Dec. 3, 1997

[51] Int. Cl.[6] ..... B05B 3/04

[52] U.S. Cl. ..... 239/222.21; 239/214; 239/222.11; 239/222.13; 239/222.15; 239/222.17; 239/231; 239/233

[58] Field of Search ..... 239/214, 222.11, 239/222.13, 222.15, 222.17, 222.21, 225.1, 231, 232, 233

[56] References Cited

U.S. PATENT DOCUMENTS

| | | | |
|---|---|---|---|
| Re. 33,823 | 2/1992 | Nelson et al. | 239/222.17 |
| 3,009,648 | 11/1961 | Hait | 239/232 X |
| 4,407,455 | 10/1983 | Sargent | 239/222.17 |
| 4,796,811 | 1/1989 | Davisson | 239/222.17 |
| 5,224,653 | 7/1993 | Nelson et al. | 239/222.17 |
| 5,297,737 | 3/1994 | Davisson | 239/222.17 |
| 5,372,307 | 12/1994 | Sesser | 239/210 |
| 5,409,168 | 4/1995 | Nelson et al. | 239/222.17 |
| 5,439,174 | 8/1995 | Sweet | 239/222.17 |
| 5,588,595 | 12/1996 | Sweet et al. | 239/222.17 |
| 5,671,886 | 9/1997 | Sesser | 239/222.21 |

*Primary Examiner*—Andres Kashnikow
*Assistant Examiner*—Robin O. Evans
*Attorney, Agent, or Firm*—Nixon & Vanderhye P.C.

[57] ABSTRACT

A sprinkler includes a sprinkler body having an inlet end and an outlet end, the outlet end having a nozzle with a discharge orifice; the nozzle surrounded by an outer wall forming an annular chamber radially spaced from the discharge orifice. A rotor plate is supported by the sprinkler body for rotation about an axis, the rotor plate having a tubular water distribution passage with an inlet and an outlet, the passage configured to cause the rotor plate to rotate when a stream from the nozzle passes therethrough. The inlet of the passage is axially spaced from the discharge orifice by a distance sufficient to aspirate air into the inlet end of the passage, thereby pulling water leaked into the chamber back into the passage.

20 Claims, 9 Drawing Sheets

FIG. 2
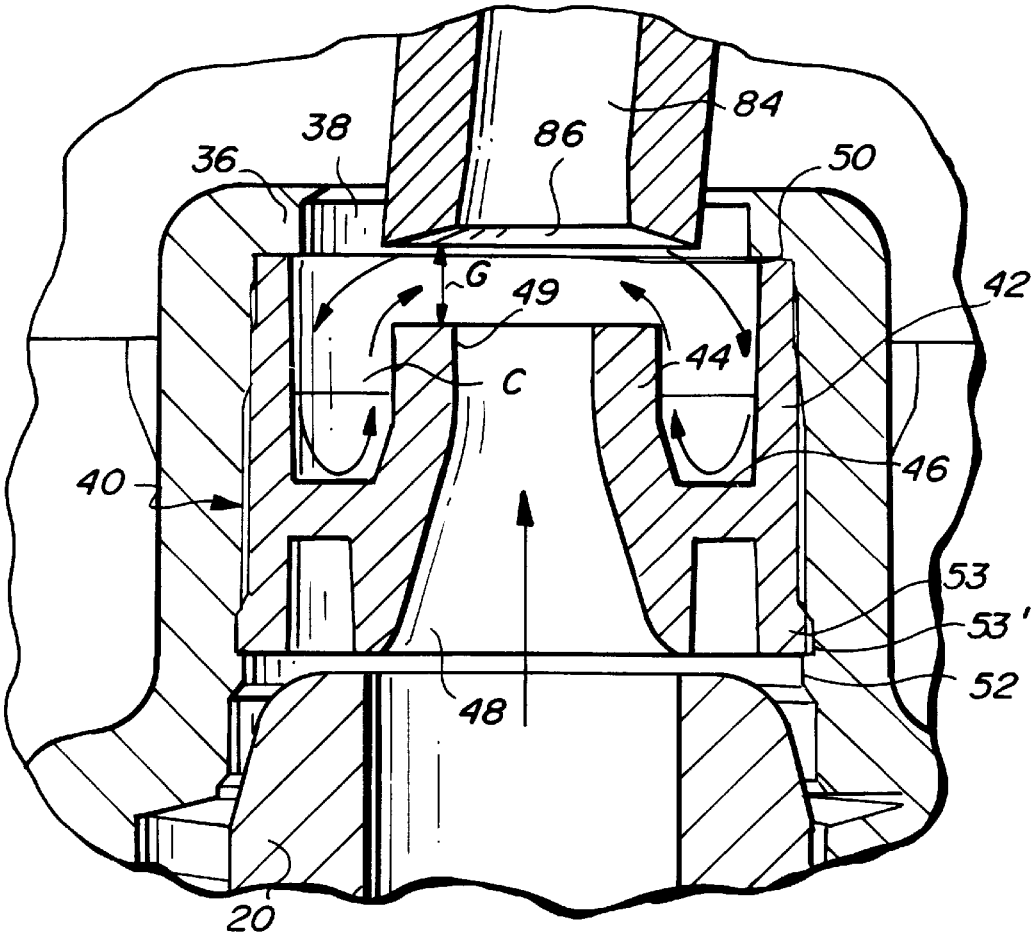
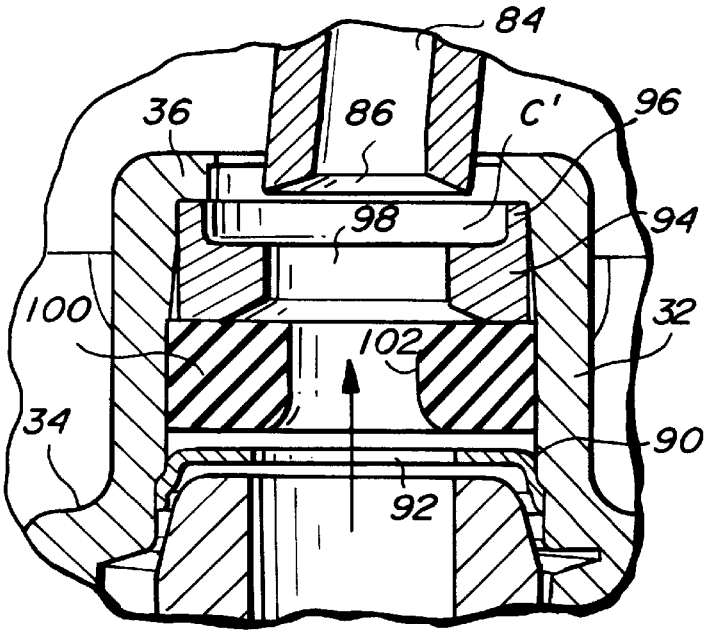
FIG. 3

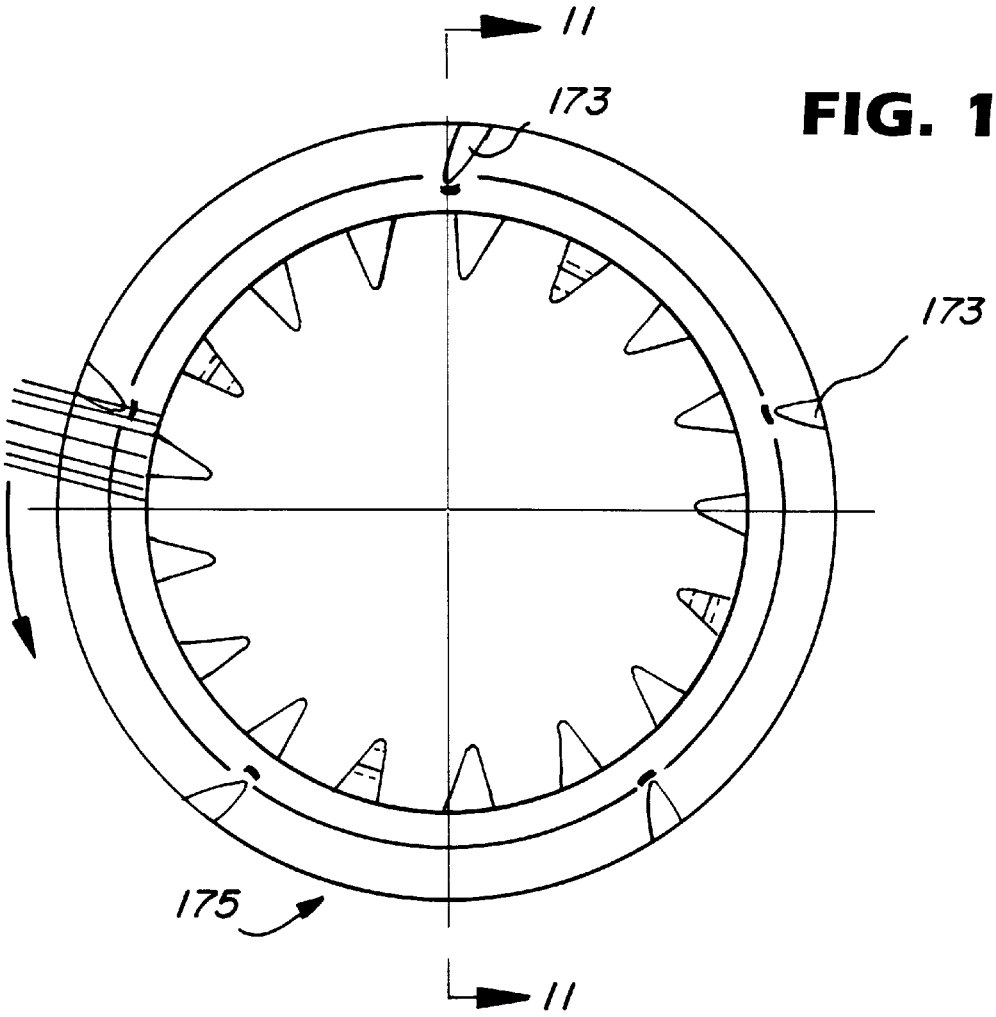
FIG. 10
FIG. 11
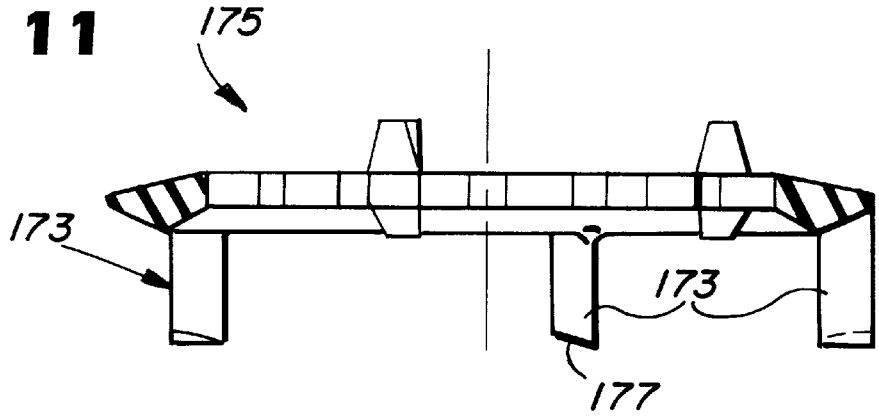

SPRINKLER WITH NOZZLE VENTURI

TECHNICAL FIELD

This invention relates generally to a sprinkler device and, more particularly, to a sprinkler with a fixed nozzle issuing a stream into a rotatably mounted water distribution or rotor plate.

BACKGROUND

It is well known in the field of irrigation generally and rotating sprinklers particularly for a sprinkler device to emit a non-rotating stream from a fixed nozzle onto a rotating plate with substantially radial grooves that also establish a moment arm, causing the plate (often referred to as a "rotor plate") to rotate about the nozzle axis. The plate also reorients the stream from vertical to substantially horizontal, distributing the water in a circular pattern. The grooves of the rotor plate may be configured to produce different wetting patterns depending on specific site applications. In some cases, the rotation of the rotor plate is slowed by a brake or "motor" in order to maximize the throw radius of the stream. In other cases, the rotor may be of the free spinning type. Examples of such sprinkler constructions may be found in commonly owned U.S. Pat. Nos. Re. 33,823; 4,796,811; 5,297,737; 5,372,307; 5,439,174; and 5,588,595.

To get maximum distance of throw in a sprinkler described generally above, it is desirable that the emitting stream be as concentrated as possible. It has been found that to obtain such a concentrated stream, it is advantageous to configure the rotor plate to have a single closed water passage that resembles a curved tube which is slightly larger in cross sectional diameter than the stream that is exiting the nozzle. The water passage needs to be substantially constant in cross sectional diameter throughout its length except for a slight flare at the entrance to help capture the stream, and a slight taper to a slightly smaller diameter at the exit. Because the size of the tubular water passage has to be so close in size to the nozzle stream, and in order to conserve space, the entry flare cannot be very large, and sometimes a small amount of the nozzle stream does not enter the water passage, but rather sprays out between the nozzle exit and the water passage entrance. This is generally due to manufacturing tolerances, i.e., the rotor plate entrance is not always perfectly aligned over the nozzle exit.

In the past, and for somewhat closed sprinkler body architecture, this leakage spray impinges on the inside diameter of the sprinkler body and then drips down the riser pipe that supports the sprinkler. For sprinklers having a more open architecture, the leakage spray carries radially a few feet before dropping to the ground. In either case, the net result is an undesirable excess of water in the first few feet around the base of the sprinkler.

DISCLOSURE OF THE INVENTION

In accordance with an exemplary embodiment of this invention, a water passage geometry is provided that produces a highly concentrated emitting stream and, in addition, the sprinkler body, nozzle and rotor plate are configured so as to minimize the amount of water that escapes out between the nozzle exit and the rotor plate entrance. In accordance with one exemplary embodiment of the invention, therefore, the entrance to the rotor plate extends down into a cavity or chamber formed around the nozzle which, in turn, is supported within the sprinkler body. As the water jets between the nozzle and the rotor plate, it creates a venturi-like transition area, i.e., a low pressure zone, resulting in an inflow of air all around the lower end of the rotor plate. The chamber is also shaped such that the water spray cannot easily exit the chamber, but, rather, is deflected around the inside of the chamber in a recirculating fashion which dissipates much of the energy in the spray. The combined effect of this loss of energy and the inflow of air causes most of the spray to be pulled back into the rotor plate entrance where it rejoins the emitting stream, thereby eliminating riser leakage except in cases of extreme misalignment of the rotor plate with the nozzle orifice.

In an alternative arrangement, a rubber flow washer is utilized as the nozzle. An annular "lid" axially above the flow washer creates a chamber from which leakage spray is drawn back up into the stream as it enters the rotor plate. The flow washer compresses under fluid pressure, reducing the nozzle diameter, and therefore keeping the flow rate constant.

In a third and preferred embodiment, an annular bearing is seated atop the sprinkler housing such that a central opening in the bearing is located above (as the sprinkler is shown in the drawings) the nozzle orifice, while at the same time providing an annular bearing surface for the lower end of the rotor plate. The latter is formed with a radially enlarged segment (extending about 90° in a circumferential direction) which engages the bearing surface as the rotor plate rotates. The lower end of the rotor plate is also formed with a flexible annular lip shield which prevents any relatively large contaminants from entering into the chamber surrounding the nozzle. By providing a bearing surface for the rotor plate, the rotor plate inlet is maintained in more accurate axial alignment with the stream emitted from the nozzle. In addition, the rotor plate can now be made of a softer, more flexible material which has certain advantages as explained further herein.

Accordingly, in its broader aspects, the invention here relates to a sprinkler comprising a sprinkler body having an inlet end and an outlet end, the outlet end having a nozzle with a discharge orifice; a rotor plate supported by the sprinkler body for rotation about an axis, the rotor plate having a tubular water distribution passage with an entrance end and an exit end, the passage configured to cause the rotor plate to rotate when a stream from the nozzle passes therethrough; and wherein the entrance end is axially spaced from the discharge orifice by a gap sufficient to aspirate air into the inlet end of the passage.

Other objects and advantages of the invention will become apparent from the detailed description which follows.

BRIEF DESCRIPTION OF THE DRAWINGS

FIG. 2 is an enlarged detail of the nozzle area of the sprinkler shown in FIG. 1;

FIG. 3 is an enlarged detail of a nozzle area of a sprinkler in accordance with an alternative embodiment of the invention;

FIG. 10 is a bottom plan view of the stream diffuser in accordance with the invention; and FIG. 11 is a section taken along the line 11—11 in FIG. 10.

BEST MODE FOR CARRYING OUT THE INVENTION

Figure 1:
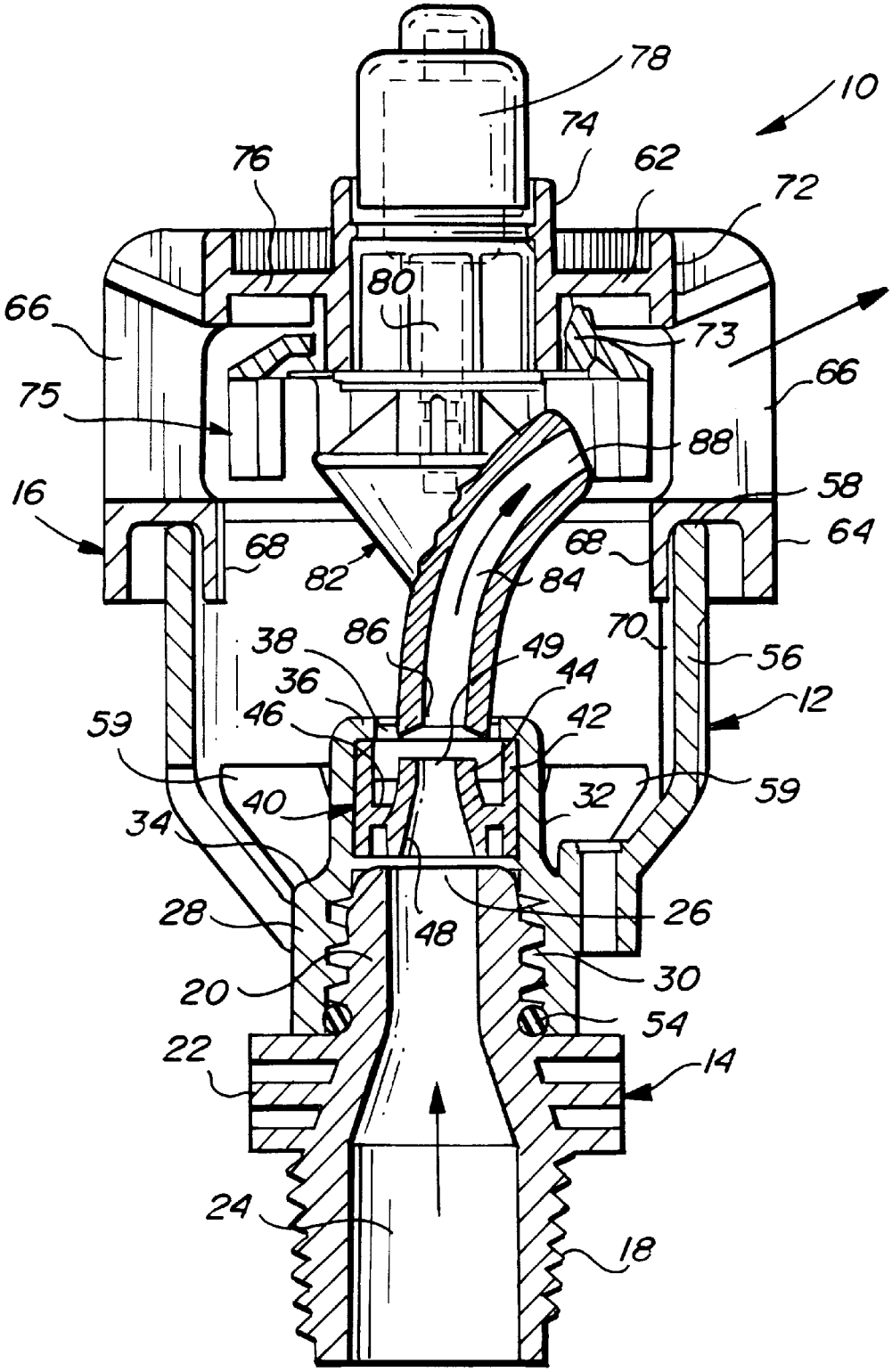
FIG. 1 is a side elevation, partly in section, illustrating a sprinkler in accordance with a first exemplary embodiment of the invention.

With reference now to FIG. 1, a sprinkler 10 in accordance with this invention includes generally a body portion 12, an inlet fitting or coupling 14, and a removable cap assembly 16. The inlet or supply coupling 14 includes a lower exteriorly threaded portion 18, and a smaller diameter exteriorly threaded upper portion 20 with a tool gripping section 22 therebetween. While the upper and lower portions 18 and 20 are substantially circular in shape, the intermediate tool gripping portion 22 may be square, hexagonal or other shape which facilitates gripping by tools such as a wrench or pliers. The interior of the coupling 14 is formed with a throughbore 24 which gradually tapers to a smaller diameter outlet at 26 from which water under pressure is admitted to the sprinkler body as described in further detail below.

The sprinkler body 12 is formed at its lower end with a generally cylindrical housing 28 having an interiorly threaded portion 30 which is adapted to threadably receive the upper threaded portion 20 of the coupling 14. A smaller diameter portion 32 of the housing 28 extends upwardly from a shoulder 34 and has a smooth interior surface terminating at a radially inwardly directed flange or lip 36 which defines a circular opening 38. Within this upper portion 32, there is located a nozzle body 40. The nozzle body 40 includes an outer sleeve 42 and the nozzle 44 connected radially by an annular, horizontal web 46. The nozzle 44 has an inlet 48 which is aligned with the outlet 26 of the coupling 14. As best seen in FIG. 2, the nozzle 44 also has a discharge orifice 49 which is located axially below the upper edge 50 of the outer sleeve 42. The nozzle body 40 is retained, within the upper portion 32 of the housing 28 by an annular inwardly projecting ring 52. In other words, as the nozzle body 40 is pressed into the housing 28 from below, the lower slightly enlarged edge 53 of sleeve 42 will be compressed radially as it passes over the ring 52 and will then snap radially outwardly into a shallow annular groove 53' so that the nozzle body is in fully seated engagement between the upper flange 36 and lower ring 52.

After insertion of the nozzle body as described above, the coupling 14 may be threadably attached, with an O-ring 54 sealing the interface between the two, preventing any water from escaping downwardly out of the housing 28.

The sprinkler body also includes an upstanding circular bowl-shaped portion 56 having an upper circular edge 58. The lower, tapered end of portion 56 is formed with openings or windows 59 (two shown in FIG. 1) which are circumferentially spaced thereabout, and generally adjacent the upper portion 32 of the housing 28.

The cap assembly 16 includes an upper support plate 62 and a lower mounting ring 64, connected by four (two shown) vertically oriented blade-like webs 66. The mounting ring 64 has a plurality of depending tabs 68 which cooperate with projections 70 (one shown) on the interior side of the bowl shaped portion 56, adjacent upper edge 58. Other cooperating cam and locking surfaces (not shown) are provided on the interior of ring 62 and on the exterior surface of bowl-shaped portion 56. These cooperating tabs, projections, etc. combine to enable secure attachment, and easy detachment, of the cap assembly from the body. The specific manner of attachment is not part of this invention per se, but may be as shown in commonly owned U.S. Pat. No. 5,224,653 or 5,409,168.

The support plate 62 includes an outer ring 72, and an inner sleeve 74 connected by a horizontal web 76. That portion of the sleeve 74 which extends above the web 76 is formed as four, equally spaced tabs. That portion of sleeve 74 below the web 76 is formed with a plurality of radially outwardly directed teeth which mesh with teeth 73 formed on a diffuser 75 in the manner described in commonly owned U.S. Pat. No. 5,372,307. Within the sleeve 74, there is supported a viscous retarder or motor 78 which may be of the type disclosed in U.S. Pat. Nos. Re. 33,823 or 4,796,811. A shaft 80 extends out of the motor 78 in a downward direction, axially aligned with the longitudinal axis A of the sprinkler body 12 and nozzle body 40. A viscous motor as described therein effectively slows the rotation of the rotor plate to maximize throw distance.

The shaft 80 supports a rotor plate 82. The rotor plate 82 formed with a closed tubular water passage 84 which has a substantially vertically oriented inlet 86 and an outlet 88 oriented at about a 26° angle relative to horizontal. In addition, the passage 84 has a slight circumferential component or twist which causes the rotor plate 82 to rotate when a stream flows through the passage.

The passage 84 has a diameter only slightly larger than the diameter of the nozzle orifice 49 with a slight flare at the inlet 86 to facilitate capture of the stream. The diameter is reduced slightly at the exit to help concentrate the emitting stream. The inlet 86 of the rotor plate 82 is substantially vertically aligned with but slightly vertically spaced from the orifice 49. At the same time, the nozzle inner diameter tapers from its upstream end through the nozzle orifice, holding turbulence to a minimum. Thus, a single concentrated stream emitted from the nozzle orifice 49 flows into the passage 84 and is thrown radially outwardly, while causing the rotor plate 82 and shaft 80 to rotate about the longitudinal axis A, with the rotational speed braked or retarded by the motor 78. If a diffuser such as that at 75 is utilized, the stream will impinge on circumferentially spaced blades of the diffuser, causing the latter to rotate, with resulting intermittent fanning of the stream to fill in a circular wetting area.

With particular reference to FIG. 2, it will be appreciated that some small amount of water issuing from the orifice 49 may leak at the "interface" of the nozzle orifice or exit 49 with the inlet 86 of the rotor plate passage 84. As already noted, this can occur as a result of manufacturing tolerances. To solve this problem, the design in accordance with this invention incorporates a water retention cavity or chamber "C" defined by the nozzle 44, the outer sleeve 42 and the horizontal web 46. Now, any water/spray which does not enter the passage 84 will collect and circulate in the chamber C as indicated by the flow arrows in FIG. 2. In addition, the nozzle 44 has been spaced vertically from the inlet 86 to the passage 84, creating a gap "G". This gap is chosen to create a low pressure or venturi effect at the nozzle exit, so that air is aspirated into the opening 38 and then into the entrance 86 of the passage 84 as the stream jets into the passage 84. The resulting low pressure will cause the water spray leaked into the chamber C to be pulled back up into the passage 84 to rejoin the stream. Performance to date indicates that the dripping water problem described above is substantially, if not completely, eliminated, except for cases of gross misalignment of the rotor plate and nozzle. Moreover, by eliminating such leakage, more water is distributed by way of the rotor plate 82, thus enhancing overall sprinkler performance.

In addition, the lip 36 may be formed with a relatively sharp point at its radially innermost point, best seen in FIG. 2. If debris, such as a grain of sand, were to become wedged between the entrance end 86 of the passage 84 and the lip 36, or between the entrance end 86 and the nozzle, it could easily stop the rotation of the slowly moving rotor plate. By making the lip 36 terminate at a sharp, radially inward edge, it is difficult for a sand grain to become wedged in that area. Any said grain which does get past the lip 36 will be small enough to pass through the area and pulled into the emitting stream and carried out of the rotor plate exit 88 without jamming of the rotor plate.

Turning now to FIG. 3, an alternative flow control nozzle option is illustrated. In this embodiment, the nozzle 44 is replaced by an assembly of individual components including an annular retainer 90 having a center opening 92 which is press fit in the smaller diameter portion 32 of the housing 28 adjacent the shoulder 34. A nozzle lid component 94 is seated within the upper portion 32 of the housing with an upwardly extending annular ring 96 seated against the radially inward directed flange 36. The lid opening 98 is spaced vertically below the inlet 86 of the flow passage 84 by a distance substantially equal to the height of the annular ring 96, thus creating a cavity or chamber C'. A rubber flow washer or nozzle 100 is located upstream of the lid 94, the nozzle discharge orifice 102 having a diameter smaller than that of the lid 94. The nozzle 100 is axially compressible under fluid pressure and, because of the presence of lid 94, the axial compression forces a reduction in the diameter of the discharge orifice 102. In this way, flow rate is maintained constant and independent of pressure. The chamber C' recirculates leakage spray in the same manner as the embodiment illustrated in FIGS. 1 and 2. Note also that the stream diameter as it exits the nozzle orifice 102 is smaller than the lid opening 98, so that the stream does not contact the lid as it passes into the inlet 86 of passage 84.

The retainer 90 simply insures that the nozzle 100 will remain in place upon removal of the coupling 14.

Turning to FIGS. 4–9, a second and preferred embodiment of the invention differs from the first described embodiment primarily in the rotor plate construction and the rotor plate/nozzle interface. Thus, only the modified or added components will be described here in detail. The sprinkler components are identified generally by reference numerals similar to those used for corresponding components in FIG. 1, but with the prefix "1" added.

Figure 4:
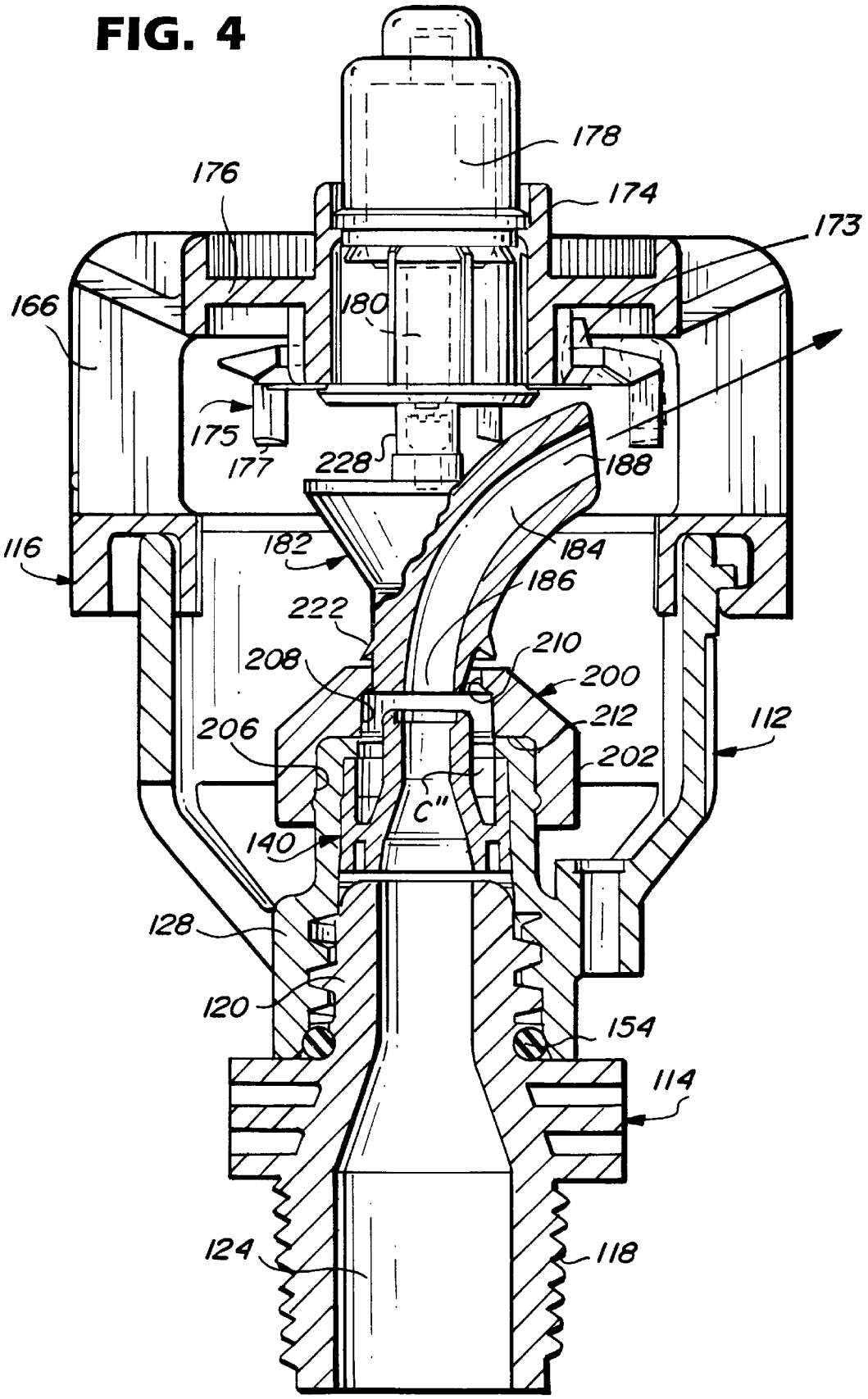
FIG. 4 is a side elevation, partly in section, illustrating a sprinkler in accordance with a preferred embodiment of the invention.

Housing 128 supports the nozzle body 140 which, in this embodiment, includes an outer sleeve 142 like the sleeve 42, but the nozzle 144 extends upwardly beyond the lip 136 of the housing 128. Thus, the discharge orifice 149 is also located above the lip 136 as best seen in FIGS. 4 and 5.

The rotor plate 182, like rotor plate 82, resembles an inverted cone, which incorporates a closed tubular water passage 184 (having the same internal configuration as passage 84) with a substantially vertically oriented inlet 186 and an outlet 188 oriented, again, at about a 26° angle to horizontal. The passage 184 also has a slight circumferential component or twist which causes the plate to rotate when a stream issuing from nozzle 144 flows through the passage 184.

Figure 5:
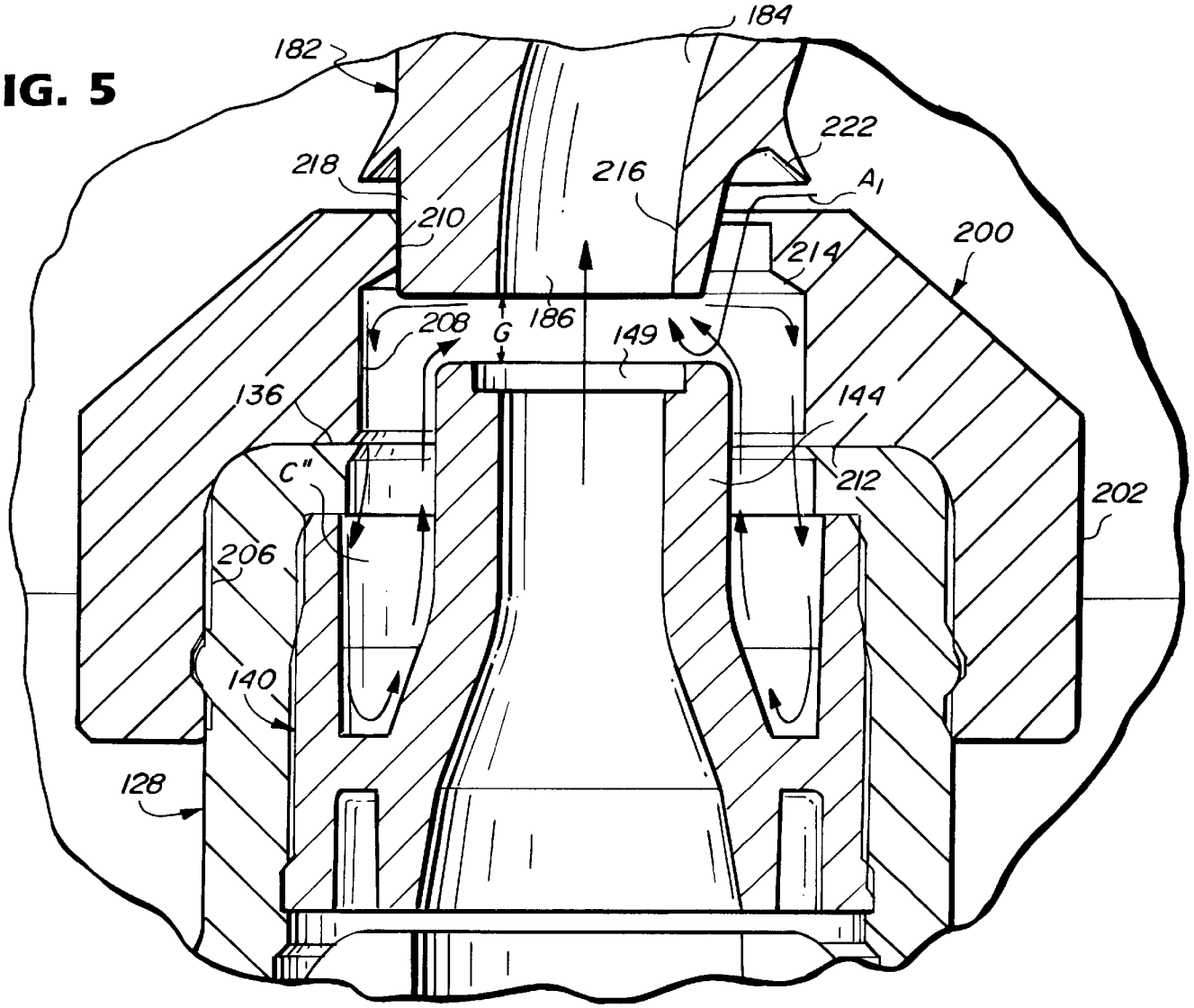
FIG. 5 is an enlarged detail of the nozzle discharge area of the sprinkler illustrated in FIG. 4.

As best seen in FIG. 5, the lower end of the rotor plate 182 is supported within an annular bearing 200 which, in turn, is supported atop the housing 128. The bearing 200 includes a peripheral skirt portion 202 which engages the upper portion of the housing 128. The bearing is counterbored at 206, 208 and 210, thus forming progressively smaller diameter openings as defined by radial shoulder 212 and tapered shoulder 214. With this arrangement, the upper end of the nozzle 144 is located within the intermediate diameter portion 208, with the discharge orifice 149 located approximately midway along the length of this portion of the bearing. The smaller diameter opening 210 at the upper end of the bearing is adapted to receive and laterally support the lower end of the rotor plate as described in greater detail below. The portion 208 of the bearing effectively increases the depth of chamber C" surrounding the nozzle, making it even more difficult for any water which does not initially pass into the rotor plate passage 184 to escape.

Figure 6:
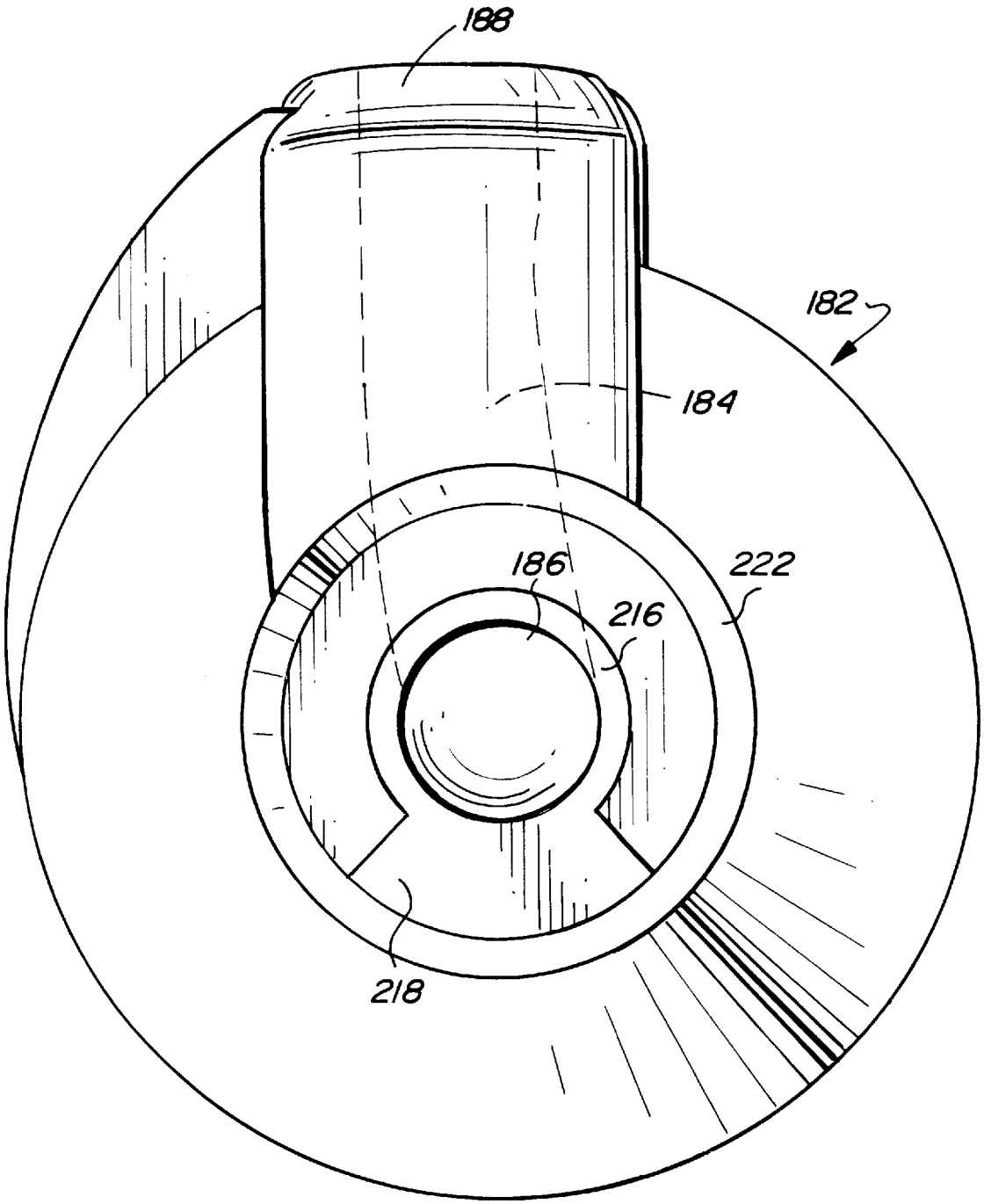
FIG. 6 is an enlarged bottom plan view of the rotor plate used in the sprinkler shown in FIG. 4.

With specific reference now to FIG. 6, it can be seen that the lower cylindrical inlet 216 of the rotor plate passage has a radially enlarged circumferential segment 218 along one exterior side thereof encompassing about 90°. As the rotor plate 182 rotates, this enlarged segment 218 engages and slides along the smallest diameter portion 210 of the bearing. In other words, at any given time, the rotor plate 182 contacts the bearing 200 only in a 90° sector or segment. More specifically, the reactionary force of the emitting stream is always pushing this segment 218 into contact with the bearing portion 210. This added lateral support for the rotor plate keeps the rotor plate entrance in better alignment with the stream issuing from the nozzle 144. As a result, the speed of rotation of the rotor plate 182 from sector to sector of its rotation, and the integrity of the stream as it emits from the rotor plate, are more uniform. If the rotor shaft 180 is not concentric with the nozzle stream due to normal manufacturing tolerances, it can create non-uniform rotation speed and non-uniform stream integrity as the rotor plate rotates from sector to sector due to the fact that the stream is impinging on the water passage surface in different places as the rotor plate rotates. The water passage geometry that produces the highly concentrated stream that is needed has little forgiveness of slight misalignment. In any event, any water which does deflect off the lower edge of the rotor plate falls into the chamber C' and into a recirculating pattern (indicated by flow arrows in FIG. 5) until it is aspirated into the rotor plate flow passage as previously described.

Since the rotor plate 182 has an added support at the lower end and is not simply cantilevered from the rotor shaft 180 as in the previously described embodiment, the rotor plate does not have to be very rigid, thereby allowing it to be made from a softer, more flexible material such as a thermoplastic elastomer (TPE). One suitable elastomer is commercially available from Dow Chemical Company and is sold under the name Pellethane 2103-55D Urethane. This is a highly abrasion resistant material which is important when using water that is contaminated with sand or other particles. Another benefit to using softer material for the rotor plate 182 is that the latter can be made to connect to the rotor shaft 180 in such a way that it will transmit the torque necessary and hang securely onto the shaft if the cap assembly is removed from the body, and yet also flex as required relative to the shaft as the rotor plate 182 rotates within the bearing 200, even if there is some misalignment between the rotor shaft and the bearing due to manufacturing tolerances.

Another feature connected with the use of softer material is that a flexible annular lip shield 222 can be included economically as an integral part of the rotor plate. This lip shield protects the area at the lower end of the rotor plate so that no large dirt or debris particles can enter into the bearing 200, particularly in the area surrounding the discharge orifice of the nozzle. Thus, any large particles of sand or other contaminants which might blow or fall into the nozzle area are prevented from passing into the bearing 200. Any particle that is small enough to get past the lip shield (in the space between the lip shield and the top of the bearing) is also small enough to pass between the rotor plate and the bearing (in the radial space between the bearing and the lower end of the rotor plate in the radial gap on either side of the segment 218) and will be pulled into the nozzle stream (see arrow $A_1$) and then carried out of the rotor plate outlet without jamming the rotor plate. Because the lip shield 222 is very flexible, if any particle gets wedged between it and the bearing, it won't create enough friction to stop the rotation of the rotor plate. The net result is a very economical integrated part that performs many different functions effectively.

Figure 7:
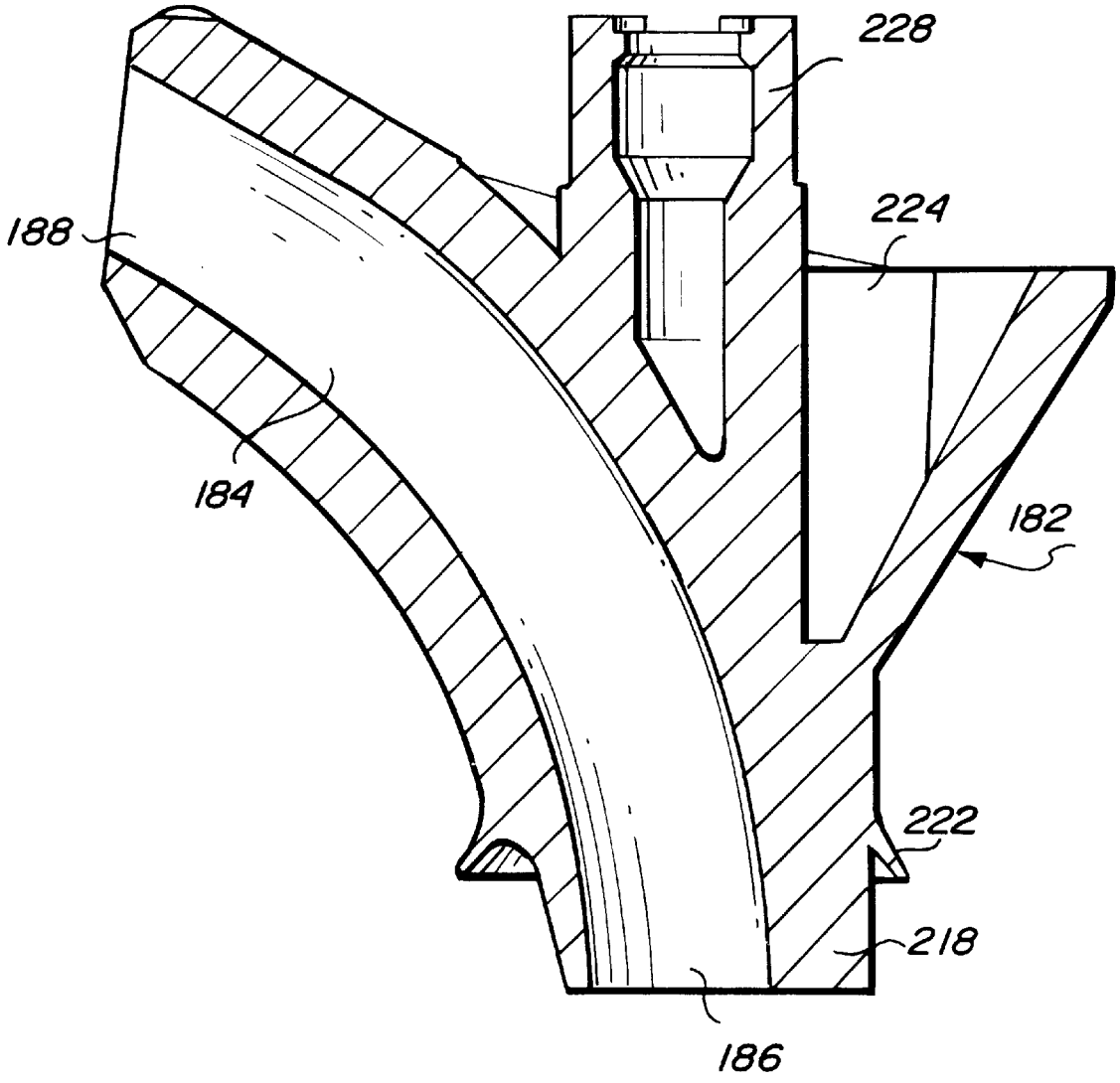
FIG. 7 is an enlarged side section of the rotor plate shown in FIG. 6.
Figure 8:
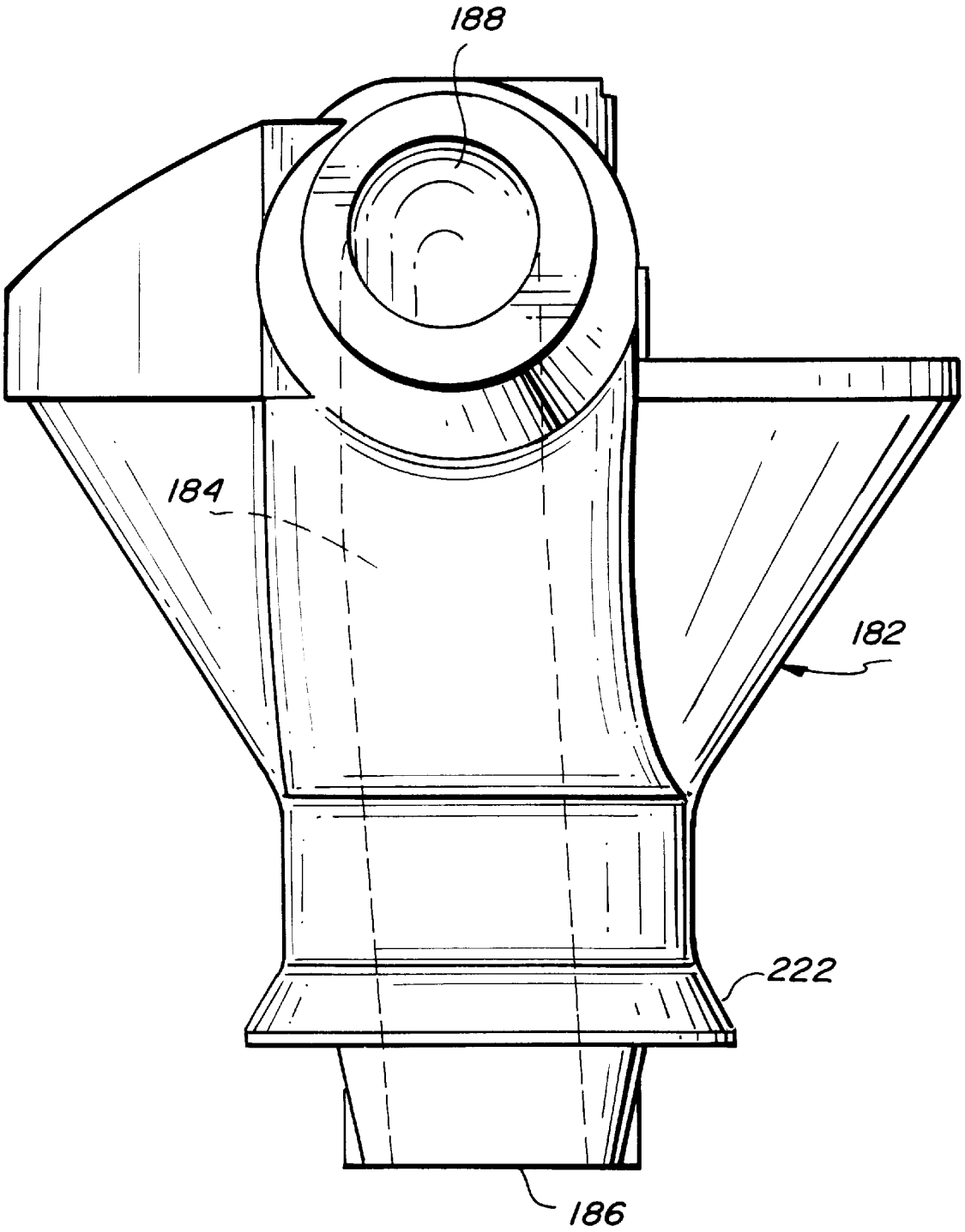
FIG. 8 is a front elevation of the rotor plate shown in FIGS. 6 and 7.
Figure 9:
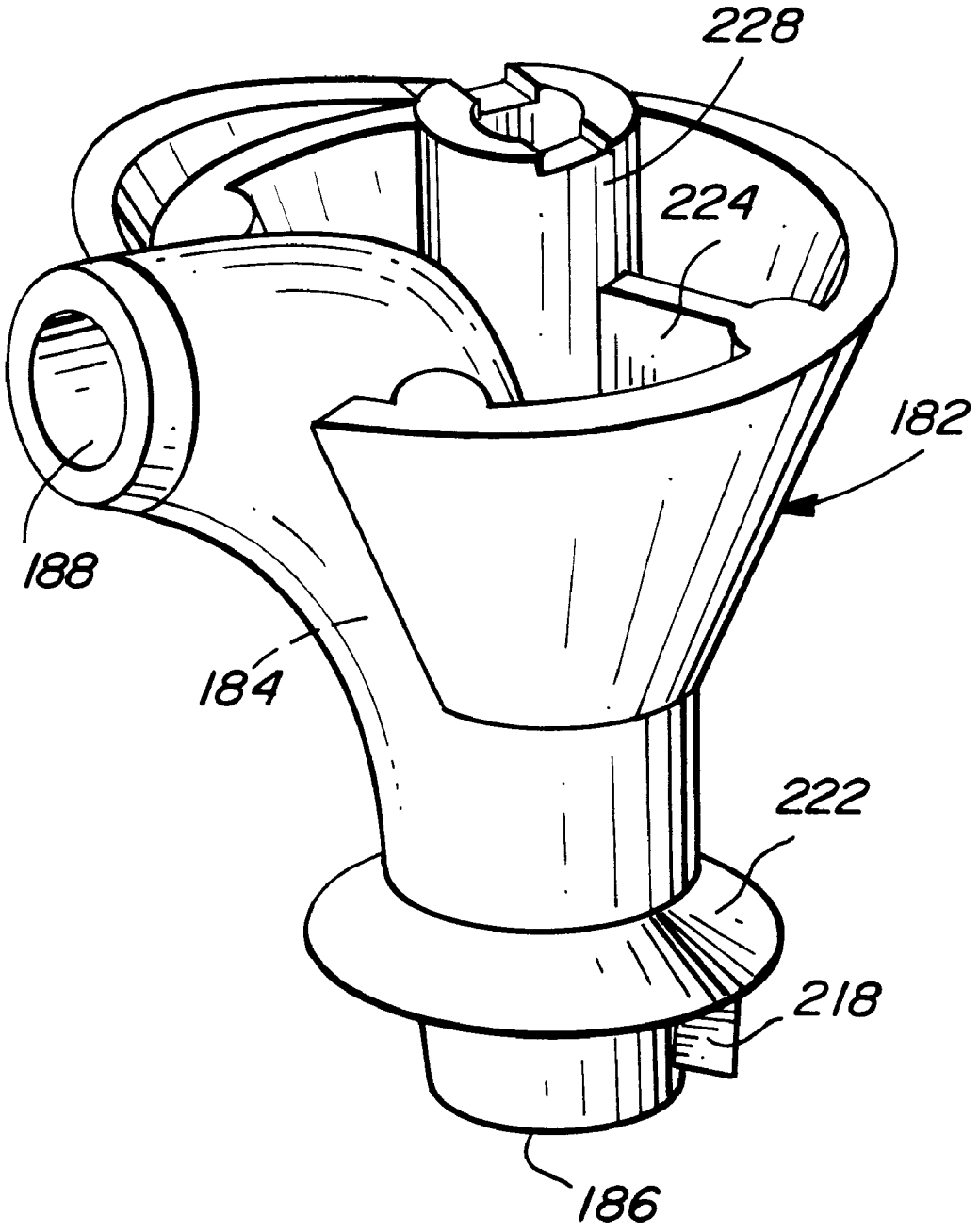
FIG. 9 is a perspective view of the rotor plate shown in FIGS. 6–8.

As best seen in FIGS. 7 and 9, the space between the outer conical wall of the rotor plate and the substantially cylindrical motor shaft receiving portion is reinforced by radial webs 224 (one shown) providing the required degree of stiffness to the rotor plate.

It should also be noted that since the rotor plate 182 is made from a relatively soft and flexible material, by making the thickness of the material relatively thin in the area of attachment bushing 228 (which receives the shaft 180), a flexible joint type action is achieved. This enables the rotor plate 182 to run within the bearing 200 without binding even if there is some misalignment between the rotor shaft 180 and the bearing due to manufacturing tolerances.

In the preferred embodiment, a further modification has been made to the diffuser 175 (FIGS. 10, 11). Specifically, it was determined to be advantageous to improve the strength of the diffuser fingers or teeth 173 over prior designs. The seemingly obvious solution would have been to make the fingers 173 thicker, but that proved difficult to do while having the diffuser 175 serve its diffusion function in a proper manner. The solution was to make the fingers 173 shorter (as well as slightly thicker), the shorter length enhancing the strength as well. By making the fingers 173 shorter, they only partially penetrate the emitted stream, so that water is deflected off the lower edge of the finger. By angling the lower edge 177 of the finger, the water deflects in such a way that it prevents the stream from pushing the diffuser backwards, resulting in a very positive forward drive. In a preferred arrangement, the lower end 177 of the finger 173 is formed at about a 12° angle relative to horizontal to improve the drive of the diffuser. In this regard, note the direction of rotation of the diffuser in FIG. 10.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler comprising:

a sprinkler body having an inlet end and an outlet end, the outlet end having a nozzle with a discharge orifice, said nozzle surrounded by an outer structure extending axially beyond said discharge orifice and creating an annular cavity radially between said nozzle and said outer structure;

a rotor plate supported by said sprinkler body for rotation about an axis, said rotor plate having a circumferentially closed, open ended tubular water distribution passage with an inlet and an outlet, said passage configured to cause said rotor plate to rotate when a stream from said nozzle passes therethrough; and said inlet of said water distribution passage extending into said cavity but axially spaced from said discharge orifice to thereby enable aspiration of air and water spray in said cavity into said water distribution passage.

2. The sprinkler of claim 1 wherein said nozzle tapers from a larger diameter inlet end to a smaller diameter outlet end.

3. The sprinkler of claim 1 wherein said nozzle comprises a compressible rubber washer, and wherein said discharge orifice has a first predetermined diameter.

4. The sprinkler of claim 3 wherein an annular lid lies adjacent said rubber washer, axially downstream thereof, said lid having a center opening with a diameter larger than said first predetermined diameter.

5. The sprinkler of claim 1 wherein said sprinkler body includes a housing having a lower end with an exteriorly threaded portion adapted for connection to a water supply conduit, and an upper end in which said nozzle is detachably secured.

6. The sprinkler device of claim 1 wherein said rotor plate is mounted on one end of a shaft, the other end of the shaft mounted within a rotational speed retarding assembly supported on said sprinkler body.

7. The sprinkler device of claim 1 and including an annular diffuser mounted concentrically with respect to said shaft and said rotor plate, and having diffusion finger elements arranged to intermittently contact a stream emitted from the exit end of said passage.

8. The sprinkler device of claim 7 wherein said diffusion finger elements extend substantially vertically a distance sufficient to cause said finger elements to only partially penetrate a stream exiting said rotor plate.

9. The sprinkler of claim 1 wherein said rotor plate is rotatably mounted in a cap assembly which is removably secured to said sprinkler body.

10. The sprinkler of claim 6 wherein said rotor plate and said rotational speed retarding assembly are mounted on a cap assembly removably secured to said sprinkler body.

11. The sprinkler of claim 5 wherein said housing is surrounded by an upstanding bowl portion supporting a removable cap assembly in which said rotor plate is supported.

12. A sprinkler comprising:

a sprinkler body having an inlet end and an outlet end, the outlet end having an axially compressible nozzle with a discharge orifice;

an annular lid downstream and abutting said nozzle, said lid having a center opening and an upstanding annular flange wherein under fluid pressure, said nozzle is compressed against said annular lid causing said discharge orifice to decrease in diameter;

a rotor plate supported by said sprinkler body for rotation about an axis, said rotor plate having a tubular water distribution passage with an inlet and an outlet, said water distribution passage configured to cause said rotor plate to rotate when a stream from said nozzle passes therethrough; and wherein said inlet of said water distribution passage is spaced above said center opening of said annular lid a distance substantially equal to a height dimension of said upstanding annular flange.

13. The sprinkler of claim 12 wherein said center opening has a diameter greater than a diameter of said discharge orifice.

14. The sprinkler of claim 12 wherein a retainer plate is located in said sprinkler body, upstream of said nozzle, said retainer plate serving to prevent said nozzle from falling out of said sprinkler body.

15. A sprinkler comprising:

a sprinkler body having an inlet end and an outlet end, the outlet end having a nozzle with a discharge orifice, wherein said nozzle is surrounded by an outer wall connected to said nozzle by a horizontal web, creating an annular cavity surrounding the nozzle; and a rotor plate supported by said sprinkler body for rotation about an axis, said rotor plate having a tubular water distribution passage with an inlet and an outlet, said passage configured to cause said rotor plate to rotate when a stream from said nozzle passes therethrough; and wherein said inlet of said water distribution passage is axially spaced from said discharge orifice by a gap sufficient to aspirate air into said passage wherein an annular bearing is supported on said sprinkler body with a reduced diameter opening therein located above said discharge orifice, interior portions of said bearing extending said outer wall to thereby enlarge said cavity.

16. The sprinkler device of claim 15 wherein a lower end of said rotor plate is provided with a flexible lip flange located above but proximate said reduced diameter opening in said bearing.

17. The sprinkler device of claim 16 wherein said lower end of said rotor plate has a radially enlarged segment in engagement with said reduced diameter opening in said bearing.

18. The sprinkler device of claim 17 wherein said segment has a circumferential extent of about 90°.

19. A sprinkler comprising:

a sprinkler body having an inlet end and an outlet end, the outlet end having a nozzle with a discharge orifice;

a rotor plate supported by said sprinkler body for rotation about an axis, said rotor plate having a tubular water distribution passage with an inlet and an outlet, said inlet of said water distribution passage substantially aligned with said nozzle and said passage configured to cause said rotor plate to rotate when a stream from said nozzle passes therethrough; and an annular diffuser located above said rotor plate and having a plurality of depending fingers circumferentially spaced thereabout, said fingers arranged to penetrate only a part of the stream exiting said passage.

20. The sprinkler of claim 19 wherein a lower edge of each of said fingers is formed at about a 12° angle to horizontal in a circumferential direction.

* * * * *